US009051843B2

(12) United States Patent
Stein et al.

(10) Patent No.: US 9,051,843 B2
(45) Date of Patent: Jun. 9, 2015

(54) TURBOMACHINE BLADE INCLUDING A SQUEELER POCKET

(75) Inventors: Alexander Stein, Simpsonville, SC (US); Bradley Taylor Boyer, Greenville, SC (US); Sylvain Pierre, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 513 days.

(21) Appl. No.: 13/284,010

(22) Filed: Oct. 28, 2011

(65) Prior Publication Data

US 2013/0108444 A1 May 2, 2013

(51) Int. Cl.
*F01D 5/00* (2006.01)
*F01D 5/20* (2006.01)

(52) U.S. Cl.
CPC ..... *F01D 5/20* (2013.01)

(58) Field of Classification Search
CPC ..... F01D 5/20; F01D 5/187
USPC ..... 415/115; 416/92, 97 R, 228
See application file for complete search history.

(56) References Cited

U.S. PATENT DOCUMENTS

| | | | | |
|---|---|---|---|---|
| 891,383 | A | | 6/1908 | Steinmetz |
| 2,392,673 | A | | 1/1946 | Kraft |
| 2,795,373 | A | | 6/1957 | Hewson |
| 3,635,585 | A | | 1/1972 | Metzler, Jr. |
| 3,854,842 | A | | 12/1974 | Caudill |
| 4,194,869 | A | | 3/1980 | Corcokios |
| 4,465,433 | A | | 8/1984 | Bischoff |
| 4,741,667 | A | | 5/1988 | Price et al. |
| 5,326,221 | A | | 7/1994 | Amyot et al. |
| 5,375,972 | A | | 12/1994 | Gray |
| 5,397,215 | A | | 3/1995 | Spear et al. |
| 5,466,123 | A | | 11/1995 | Rose |
| 5,525,038 | A | | 6/1996 | Sharma et al. |
| 5,581,996 | A | | 12/1996 | Koch et al. |
| 5,927,946 | A | * | 7/1999 | Lee ..... 416/97 R |
| 6,077,036 | A | | 6/2000 | Heffron et al. |

(Continued)

FOREIGN PATENT DOCUMENTS

| | | | |
|---|---|---|---|
| EP | 2138727 | A2 | 12/2009 |
| WO | 03052240 | A2 | 6/2003 |

OTHER PUBLICATIONS

Extended European Search Report cited in EP Application No. 12187836.7-1610, dated Mar. 4, 2013, pp. 1-7.

(Continued)

*Primary Examiner* — Dwayne J White
*Assistant Examiner* — Jason Fountain
(74) *Attorney, Agent, or Firm* — Cantor Colburn LLP

(57) ABSTRACT

A turbine blade includes an airfoil portion including a suction side having a suction side contour, a pressure side having a pressure side contour, a leading edge, a trailing edge and a tip portion, and a squeeler pocket formed in the tip portion. The squeeler pocket includes a first side wall and a second side wall. The first side wall includes a first internal surface having a first substantially continuous curvilinear profile and the second side wall includes a second internal surface having a second substantially continuous curvilinear profile. A bleed passage extends from the squeeler pocket towards the trailing edge. The first and second side walls are configured to deliver a substantially unobstructed fluid flow from the squeeler pocket to the bleed passage and limit the fluid flow spillage onto one of the pressure side and the suction side.

8 Claims, 3 Drawing Sheets

(56) References Cited

U.S. PATENT DOCUMENTS

| | | | | |
|---|---|---|---|---|
| 6,126,394 | A | 10/2000 | Matsuda | |
| 6,224,336 | B1 | 5/2001 | Kercher | |
| 6,283,713 | B1 | 9/2001 | Harvey et al. | |
| 6,375,420 | B1 | 4/2002 | Tanuma et al. | |
| 6,478,537 | B2 | 11/2002 | Junkin | |
| 6,561,761 | B1 | 5/2003 | Decker et al. | |
| 6,669,445 | B2 | 12/2003 | Staubach et al. | |
| 6,709,223 | B2 | 3/2004 | Walto et al. | |
| 6,709,233 | B2 | 3/2004 | Haller | |
| 6,779,973 | B2 | 8/2004 | Ito et al. | |
| 6,802,695 | B2 | 10/2004 | Haller | |
| 6,969,232 | B2 | 11/2005 | Zess et al. | |
| 7,044,710 | B2 | 5/2006 | Naik et al. | |
| 7,048,509 | B2 | 5/2006 | Tominaga et al. | |
| 7,186,074 | B2 | 3/2007 | Blatchford et al. | |
| 7,390,171 | B2 | 6/2008 | Francini | |
| 7,520,728 | B2 | 4/2009 | Sleiman et al. | |
| 7,607,893 | B2 | 10/2009 | Lee et al. | |
| 7,632,075 | B2 | 12/2009 | Liang et al. | |
| 7,740,449 | B1 | 6/2010 | Brown et al. | |
| 7,887,297 | B2 | 2/2011 | Allen-Bradley et al. | |
| 8,011,889 | B1 * | 9/2011 | Liang | 416/97 R |
| 8,202,039 | B2 | 6/2012 | Guemmer | |
| 8,459,956 | B2 | 6/2013 | Pandey et al. | |
| 2002/0054817 | A1 | 5/2002 | Tanuma et al. | |
| 2002/0098082 | A1 | 7/2002 | Ito et al. | |
| 2002/0197156 | A1 | 12/2002 | Haller | |
| 2005/0019157 | A1 | 1/2005 | Tominaga et al. | |
| 2006/0120864 | A1 | 6/2006 | Lu et al. | |
| 2006/0140768 | A1 | 6/2006 | Tam et al. | |
| 2006/0222490 | A1 | 10/2006 | Senoo et al. | |
| 2006/0269399 | A1 | 11/2006 | Girgis et al. | |
| 2007/0086891 | A1 | 4/2007 | Nomura et al. | |
| 2007/0224035 | A1 | 9/2007 | Nigmatulin | |
| 2007/0258818 | A1 | 11/2007 | Allen-Bradley et al. | |
| 2008/0050243 | A1 * | 2/2008 | Liang | 416/97 R |
| 2008/0175714 | A1 * | 7/2008 | Spangler et al. | 416/232 |
| 2008/0199310 | A1 | 8/2008 | Nomura et al. | |
| 2009/0162193 | A1 | 6/2009 | Mariotti et al. | |
| 2009/0162200 | A1 | 6/2009 | Tibbott et al. | |
| 2010/0074734 | A1 | 3/2010 | Little | |
| 2010/0098554 | A1 * | 4/2010 | Cheong et al. | 416/97 R |
| 2010/0158696 | A1 * | 6/2010 | Pandey et al. | 416/243 |
| 2010/0172749 | A1 | 7/2010 | Mitsuhashi et al. | |
| 2010/0254797 | A1 | 10/2010 | Grover et al. | |
| 2010/0284818 | A1 | 11/2010 | Sakamoto et al. | |
| 2010/0300101 | A1 | 12/2010 | Swintek et al. | |
| 2011/0052387 | A1 | 3/2011 | Kneeland et al. | |
| 2011/0052413 | A1 * | 3/2011 | Kwon et al. | 416/97 R |
| 2013/0017095 | A1 | 1/2013 | Lee et al. | |

OTHER PUBLICATIONS

Extended European Search Report for EP Application No. 12189881.1-1610, dated May 13, 2014, pp. 1-6.

Extended European Search Report for EP Application No. 12189836.5-1607, dated Jun. 20, 2013, pp. 1-6.

* cited by examiner

TURBOMACHINE BLADE INCLUDING A SQUEELER POCKET

BACKGROUND OF THE INVENTION

The subject matter disclosed herein relates to the art of turbomachines and, more particularly, to a turbomachine blade having a tip portion including a squeeler pocket.

In general, gas turbomachines include a combustor assembly within which a fuel/air mixture is combusted to release heat energy. The heat energy forms a high temperature gas stream that is channeled to a turbine portion via a hot gas path. The hot gas stream flows over rotor blades that convert thermal energy from the high temperature gas stream to mechanical energy that rotates a turbine shaft. The turbine portion may be used in a variety of applications, such as for providing power to a pump or an electrical generator.

The rotor blades typically include an airfoil, having a pressure side and a suction side joined by leading and trailing edges, which guide the hot gas stream along the hot gas path. The airfoil is generally joined to a base portion having a dovetail mount. The dovetail mount provides an interface to a turbine rotor which, in addition to supporting the rotor blades, provides a delivery pathway for cooling air. More specifically, cooling air is guided from the turbine rotor into cavities formed in the rotor blades. The cooling air flows through the cavities to lower temperatures at the pressure side, suction side and the leading and trailing edges. In addition, rotor blades are formed with tip cavities that receive a portion of the cooling air. The cooling air passing into the tip cavity lowers temperatures at tip portions of the rotor blades.

BRIEF DESCRIPTION OF THE INVENTION

According to one aspect of the exemplary embodiment, a turbine blade includes an airfoil portion including a suction side having a suction side contour, a pressure side having a pressure side contour, a leading edge, a trailing edge and a tip portion, and a squeeler pocket formed in the tip portion. The squeeler pocket includes a base wall, a first side wall that extends along the pressure side between the leading edge and the trailing edge, and a second side wall that extends along the suction side between the leading edge and the trailing edge. The first side wall includes a first internal surface having a first substantially continuous curvilinear profile and the second side wall includes a second internal surface having a second substantially continuous curvilinear profile. A bleed passage extends from the squeeler pocket towards the trailing edge. The first and second side walls are configured to deliver a substantially unobstructed fluid flow from the squeeler pocket to the bleed passage and limit the fluid flow spillage onto one of the pressure side and the suction side.

According to another aspect of the exemplary embodiment, a turbomachine includes a compressor portion, a combustor assembly fluidly coupled to the compressor portion, and a turbine portion operatively coupled to the compressor portion and fluidly connected to the combustor assembly. The turbine portion includes a turbine blade provided with an airfoil portion including a suction side having a suction side contour, a pressure side having a pressure side contour, a leading edge, a trailing edge and a tip portion. A squeeler pocket is formed in the tip portion. The squeeler pocket includes a base wall, a first side wall that extends along the pressure side between the leading edge and the trailing edge, and a second side wall that extends along the suction side between the leading edge and the trailing edge. The first side wall includes a first internal surface having a first substantially continuous curvilinear profile, and the second side wall includes a second internal surface having a second substantially continuous curvilinear profile. A bleed passage extends from the squeeler pocket towards the trailing edge. The first and second side walls are configured to deliver a substantially unobstructed fluid flow from the squeeler pocket to the bleed passage and limit the fluid flow spillage onto one of the pressure side and the suction side.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
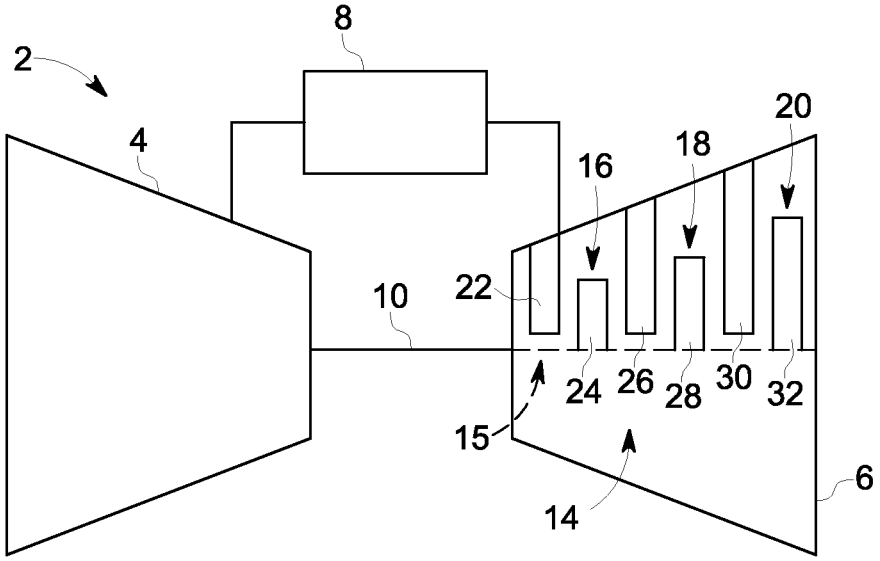
FIG. 1 is a schematic diagram of a turbomachine including a turbine blade in accordance with an exemplary embodiment.

With reference to FIG. 1, a turbomachine in accordance with an exemplary embodiment is indicated generally at 2. Turbomachine 2 includes a compressor portion 4 and a turbine portion 6. Compressor portion 4 is fluidly coupled to turbine portion 6 through a combustor assembly 8. Compressor portion 4 is also mechanically linked to turbine portion 6 via a common compressor/turbine shaft 10. Turbine portion 6 includes a plurality of turbine stages 14 that extend along a hot gas path 15. Turbine stages 14 include a first stage 16, a second stage 18, and a third stage 20. Of course, it should be understood that the number of stages for turbine portion 6 could of course vary. First stage 16 includes a plurality of stators or stationary vanes one of which is indicated at 22, and a plurality of rotating airfoil members or turbine blades one of which is indicated at 24. Likewise, second stage 18 includes a plurality of second stage stators or stationary vanes, one of which is indicated at 26, and second stage rotating airfoil members or turbine blades, one of which is indicated at 28. Third stage 20 includes a plurality of third stage stators or stationary vanes, one of which is indicated at 30, and a plurality of third stage rotating airfoil members or turbine blades, one of which is indicated at 32.

Figure 2:
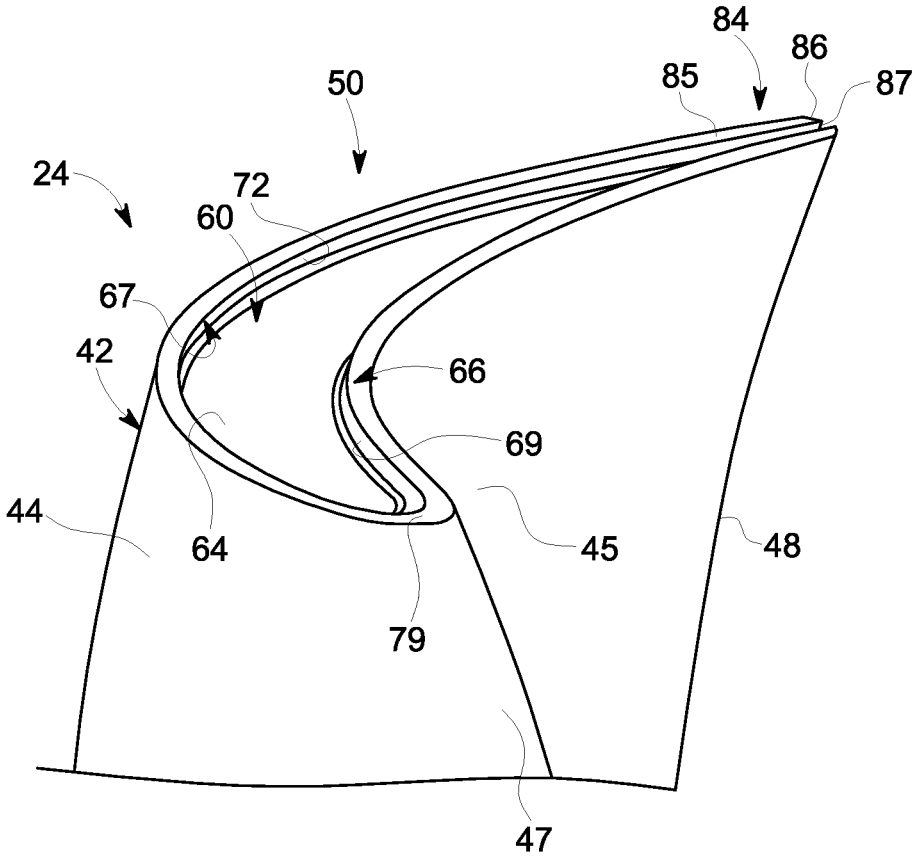
FIG. 2. is partial perspective side view of a turbine blade including a squeeler pocket and bleed passage in accordance with an exemplary embodiment.
Figure 3:
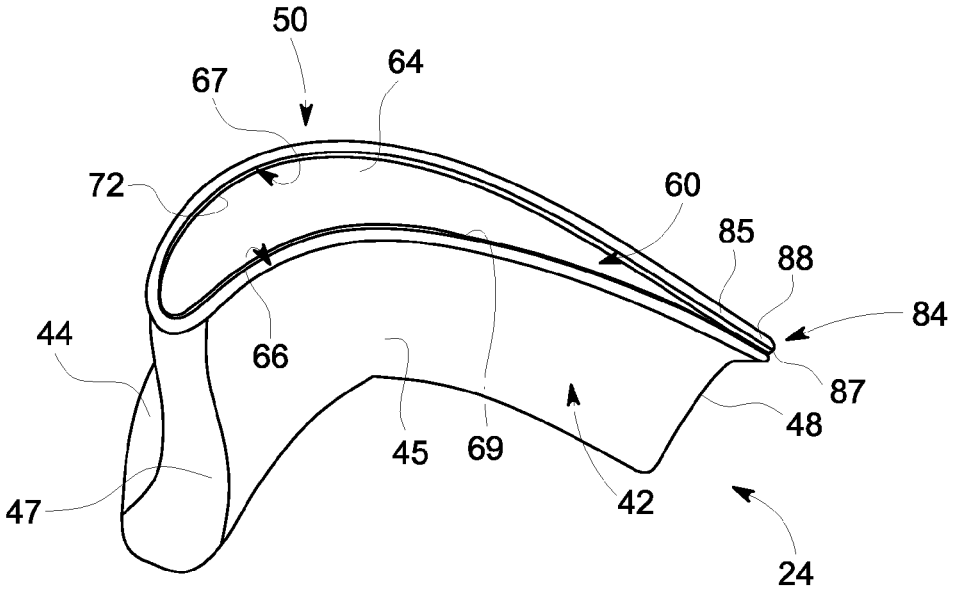
FIG. 3 is a partial perspective upper view of the turbine blade of FIG. 2.

Reference will now be made to FIGS. 2 and 3 in describing first stage turbine blade 24 with an understanding that second and third stage blades 28 and 32 could include similar structure. Turbine blade 24 includes an airfoil portion 42 having a suction side 44 including a suction side contour (not separately labeled), and a pressure side 45 having a pressure side contour (also not separately labeled). Suction side 44 and pressure side 45 extend between a leading edge 47 and a trailing edge 48. In the exemplary embodiment shown, turbine blade 24 includes a tip portion 50 provided with a squeeler pocket 60. As will be discussed more fully below, squeeler pocket 60 conditions working fluid flowing over turbine blade 24 to prevent spillage over tip portion 50. Reducing spillage enhances turbomachine efficiency by directing a greater portion of the working fluid onto working surfaces of turbine portion 6.

In accordance with an exemplary embodiment, squeeler pocket 60 includes a base wall 64 that is bounded by first and second side walls 66 and 67. First sidewall 66 includes a first inner surface 69 having a substantially continuous curvilinear profile. Similarly, second sidewall 67 includes a second inner surface 72 having a substantially continuous curvilinear profile. More specifically, first inner surface includes a substantially continuous curvilinear profile that substantially mirrors the pressure side contour. Second inner surface 72 includes a substantially continuous curvilinear profile that substantially mirrors the suction side contour. At this point it should be understood that the phrase "substantially continuous curvilinear profile" should be understood to describe a curvilinear wall having substantially no excursions (bumps and the like) between leading edge 47 along a path toward trailing edge 48.

In further accordance with the exemplary embodiment, tip portion 50 includes a bleed passage 84 that extends from squeeler pocket 60 to trailing edge 48. Bleed passage 84 is exposed at tip portion 50 and includes a first end portion 85 that extends from squeeler pocket 60 to a second end portion 86. In the exemplary aspect shown, second end portion 86 is provided with an outlet 87 shown in the form of an opening (not separately labeled) formed in trailing edge 48 at tip portion 50. Outlet 87 provides a pathway for working fluid entering squeeler pocket 60 to exit tip portion 50 without spilling over onto a working surface. Moreover, by providing a substantially continuous curvilinear profile for first and second side walls 66 and 67, turbulence in the working fluid entering squeeler pocket 60 is reduced thereby substantially reducing or eliminating spillage or over flow onto pressure side 45 or suction side 44. The reduction or elimination of overflow increases turbine efficiency.

Figure 4:
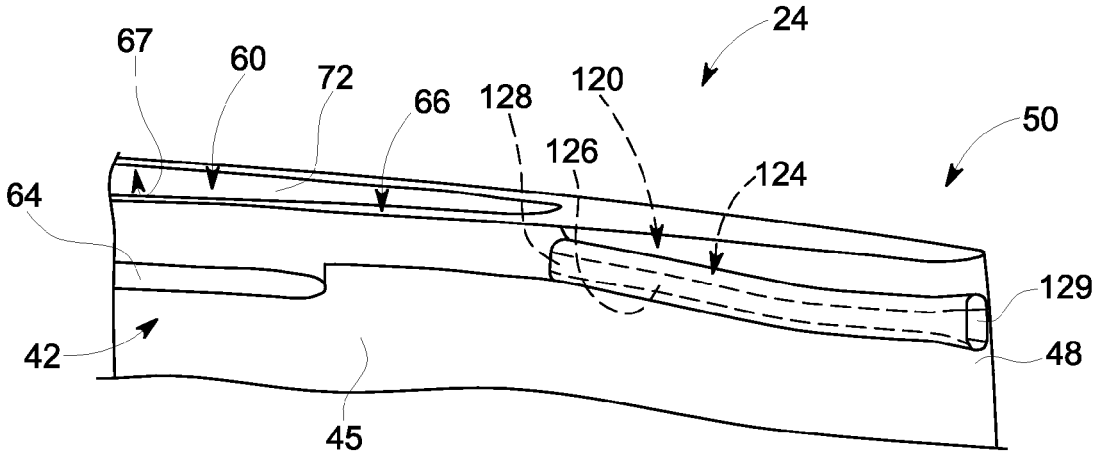
FIG. 4 is a partial perspective side view of a turbine blade including a squeeler pocket and a bleed passage shown in the form of a bleed conduit in accordance with another aspect of the exemplary embodiment.

Reference will now be made to FIG. 4, wherein like reference numbers represent corresponding parts in the respective views, in describing a bleed passage 120 in accordance with another aspect of the exemplary embodiment. Bleed passage 120 takes the form of a bleed conduit 124 is encapsulated by tip portion 50. More specifically, bleed conduit 124 extends through airfoil portion 42. More specifically, bleed conduit 124 includes a wall section 126 that is completely contained within airfoil portion 42. With this arrangement, bleed conduit 124 includes a first end or inlet 128 that is open to squeeler pocket 60 and a second end or outlet 129 that is open at trailing edge 48. In this manner, working fluid entering squeeler pocket 60 enters into bleed conduit 124 through inlet 128 and is discharged through trailing edge 48 via outlet 129.

Figure 5:
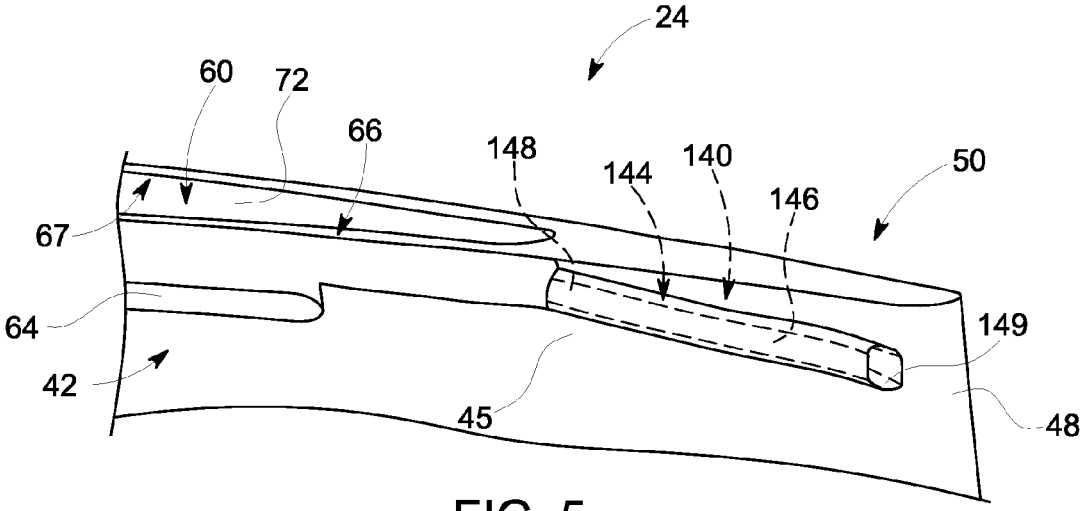
FIG. 5 is a partial perspective side view of a turbine blade including a squeeler pocket and a bleed passage shown in the form of a bleed conduit in accordance with yet another aspect of the exemplary embodiment.

Reference will now be made to FIG. 5, wherein like reference numbers represent corresponding parts in the respective views, in describing a bleed passage 140 in accordance with another aspect of the exemplary embodiment. Bleed passage 140 takes the form of a bleed conduit 144 that is encapsulated by tip portion 50. More specifically, bleed conduit 144 extends through airfoil portion 42. More specifically, bleed conduit 144 includes a wall section 146 that is completely contained within airfoil portion 42. With this arrangement, bleed conduit 144 includes a first end or inlet 148 that is open to squeeler pocket 60 and a second end or outlet 149 that is open at pressure side 45. In this manner, working fluid entering squeeler pocket 60 enters into bleed conduit 144 through inlet 148 and is discharged through pressure side 45 via outlet 149.

Figure 6:
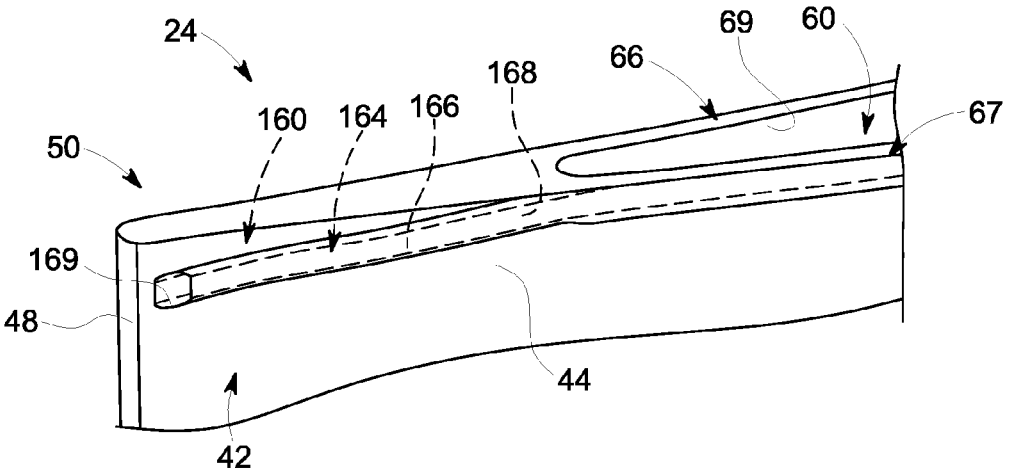
FIG. 6 is a partial perspective side view of a turbine blade including a squeeler pocket and a bleed passage shown in the form of a bleed conduit in accordance with still another aspect of the exemplary embodiment.

Reference will now be made to FIG. 6, wherein like reference numbers represent corresponding parts in the respective views, in describing a bleed passage 160 in accordance with another aspect of the exemplary embodiment. Bleed passage 160 takes the form of a bleed conduit 164 that is encapsulated by tip portion 50. More specifically, bled conduit 164 extends through airfoil portion 42. More specifically, bleed conduit 164 includes a wall section 166 that is completely contained within airfoil portion 42. With this arrangement, bleed conduit 164 includes a first end or inlet 168 that is open to squeeler pocket 60 and a second end or outlet 169 that is open at suction side 44. In this manner, working fluid entering squeeler pocket 60 enters into bleed conduit 164 through inlet 168 and is discharged through suction side 44 via outlet 149.

At this point it should be understood that the exemplary embodiments describe a squeeler pocket that is designed to deliver a substantially unobstructed fluid flow to the bleed passage to reduce working fluid spillage over a tip portion of a turbine blade. The substantiality continuous curvilinear side portions of the squeeler pocket reduces abrupt pressure increases resulting from sudden flow area reductions in the bleed passage. The bleed passage directs the fluid from the squeeler pocket through a surface of the turbine blade so as to reduce losses. That is, the working fluid that has passed into the squeeler pocket is guided back into the turbine portion to remix with the working fluid flowing along the hot gas path.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine blade comprising:

an airfoil portion including a suction side having a suction side contour, a pressure side having a pressure side contour, a leading edge, a trailing edge and a tip portion;

a squeeler pocket formed in the tip portion, the squeeler pocket including a base wall having an uninterrupted surface, a first side wall that extends along the pressure side between the leading edge and the trailing edge, and a second side wall that extends along the suction side between the leading edge and the trailing edge, the first side wall including a first internal surface having a first continuous curvilinear profile extending from the tip portion to the trailing edge, and the second side wall including a second internal surface having a second continuous curvilinear profile extending from the tip portion to the trailing edge; and a bleed passage exposed at the tip portion extending from the squeeler pocket towards the trailing edge, wherein the first and second side walls are configured to deliver a substantially unobstructed fluid flow from the squeeler pocket to the bleed passage and limit fluid flow spillage onto one of the pressure side and the suction side, wherein the first and second substantially continuous curvilinear profiles extend through the bleed passage to the trailing edge.

2. The turbine blade according to claim 1, wherein the first substantially continuous curvilinear profile substantially mirrors the pressure side contour.

3. The turbine blade according to claim 1, wherein the second substantially continuous curvilinear profile substantially mirrors the suction side contour.

4. The turbine blade according to claim 1, wherein the bleed passage includes an outlet formed in the trailing edge.

5. A turbomachine comprising:

a compressor portion;

a combustor assembly fluidly coupled to the compressor portion; and a turbine portion operatively coupled to the compressor portion and fluidly connected to the combustor assembly, the turbine portion including a turbine blade comprising:

an airfoil portion including a suction side having a suction side contour, a pressure side having a pressure side contour, a leading edge, a trailing edge and a tip portion;

a squeeler pocket formed in the tip portion, the squeeler pocket including a base wall having an uninterrupted surface, a first side wall that extends along the pressure side between the leading edge, and the trailing edge and a second side wall that extends along the suction side between the leading edge and the trailing edge, the first side wall including a first internal surface having a first continuous curvilinear profile extending from the tip portion to the trailing edge, and the second side wall including a second internal surface having a second continuous curvilinear profile extending from the tip portion to the trailing edge; and a bleed passage exposed at the tip portion extending from the squeeler pocket towards the trailing edge, wherein the first and second side walls are configured to deliver a substantially unobstructed fluid flow from the squeeler pocket to the bleed passage and limit fluid flow spillage onto one of the pressure side and the suction side, wherein the first and second substantially continuous curvilinear profiles extend through the bleed passage to the trailing edge.

6. The turbomachine according to claim 5, wherein the first substantially continuous curvilinear profile substantially mirrors the pressure side contour.

7. The turbomachine according to claim 5, wherein the second substantially continuous curvilinear profile substantially mirrors the suction side contour.

8. The turbomachine according to claim 5, wherein the bleed passage includes an outlet formed in the trailing edge.

* * * * *